United States Patent [19]

Lin

[11] Patent Number: 5,034,730

[45] Date of Patent: Jul. 23, 1991

[54] AUTOMATIC GAS SPRAY DEVICE & ITS SAFETY SYSTEM

[76] Inventor: Der-Song Lin, 3F, No. 249, Ching-Ping Road, Chung Ho City, Taipei Hsien, Taiwan

[21] Appl. No.: 458,771

[22] Filed: Dec. 29, 1989

[51] Int. Cl.[5] ..... G08B 3/00; B67D 5/00

[52] U.S. Cl. ..... 340/691; 222/3; 340/574

[58] Field of Search ..... 340/691, 574, 566–567, 340/539; 109/29–33; 222/3, 23, 39, 41, 79, 544; 239/71; 361/170

[56] References Cited

U.S. PATENT DOCUMENTS 4,054,752 10/1977 Dennis, Jr. et al. ..... 340/574 X
4,060,039 11/1977 Lagarrigue ..... 340/574 X
4,118,691 10/1978 Sims ..... 222/3
4,394,934 7/1983 Fegley ..... 222/5
4,903,863 2/1990 Fink ..... 222/61

*Primary Examiner*—Glen R. Swann, III
*Assistant Examiner*—Thomas J. Mullen, Jr.
*Attorney, Agent, or Firm*—Dvorak and Traub

[57] ABSTRACT

This invention relates to a type of "automatic gas spray device & its safety system", particularly to one that can be installed at various locations to automatically spray irritative gas activated by an electronic control main unit and a sensor in case of an attack, robbery or burglary to hinder villains and with a closed-circuit monitor, illumination equipment, alarm and such components as solenoid sensor to comprise an integrated safety system, so that in case of an emergency, to simultaneously give alarm and switch on the illumination equipment and take a photo of the villain with a closed-circuit monitor to facilitate identification of the villain.

2 Claims, 3 Drawing Sheets

AUTOMATIC GAS SPRAY DEVICE & ITS SAFETY SYSTEM

BACKGROUND OF THE INVENTION

This invention relates to a type of "automatic gas spray device & its safety system", particularly to one that can be installed at various locations to automatically spray irritative gas activated by electronic control main unit and a sensor in case of an attack, robbery or burglary to supress villains, and with a closed-circuit monitor, illumination equipment, alarm and such components as solenoid sensor, vibration sensor, etc. to compose an integrated safety system, so that in case of an emergency, to simultaneously give alarm and switch on the illumination equipment and take the photo of the villain from the closed-circuit monitor to facilitate identification of the villain.

Robbery and burglary have been known through long history. In this day of highly advanced science and technology and upgraded living standards, however, robbery and burglary are not on the decline. Villains are nowadays using more dangerous weapons than before. When the police arrives at the scene of a robbery case, the villains would have gone away leaving no trace behind. Therefore, it is imperative to develop a more effective protection device to ensure the safety of human life and properties. In view of the above, the inventor has actively studied the ways to solve such problems, and has come up with a type of "automatic gas spray device & its safety system" which will be able to protect human life and reduce financial loss. This invention is mainly composed of a gas cylinder a solenoid, sliding seat, spray nozzle, base casing, adjustment seat, fixing rod to form an automatic gas spray device which is installed in a particular place at one's house or other locations, when the robber activates the sensor, the pushing rod at the center of solenoid pushes the gas cylinder in the sliding seat, gas is sprayed from the nozzle to stop the robber. Meanwhile, it activates the alarm, lighting fixture and closed circuit monitor, as well as an automatic call to nearby police force or relatives or friends. This invention, can be used at one's house and other facilities or locations to protect human life and properties against robbers.

SUMMARY OF THE INVENTION

This invention is a type of "automatic gas spray device and its safety system" particularly one that can be installed at a particular location or one's house to spray gas at the robber or burglar and meanwhile to give alarm sound and switch on illumination equipment and closed-circuit monitor and to automatically notify nearby police force or relatives or friends, to achieve the purpose of arresting the villains.

DETAILED DESCRIPTION OF THE PRESENT INVENTION

Figure 1:
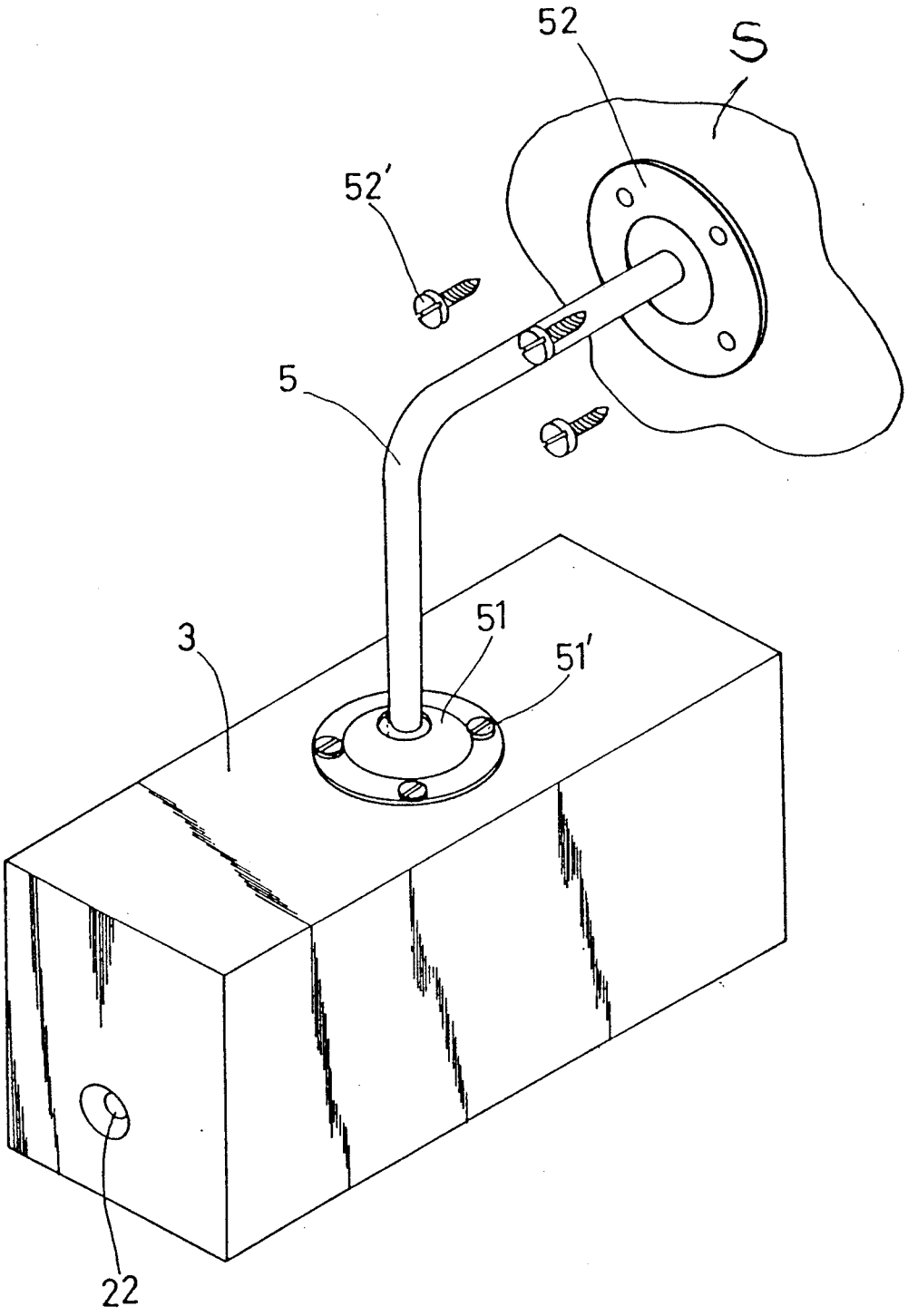
FIG. 1 is the embodiment perspective view of the invention.

This invention is to provide a type of "automatic gas spray device and its safety system", to provide a safety measure to various location or residences, to quickly spray gas to stop a robber (burglar), and meanwhile to activate an alarm (30) and illumination equipment (32) to facilitate a closed-circuit monitor (34) to take photos of the robber (burglar) to enable easy apprehension. By means of an automatic gas spray device (35) and described electronic control main unit (36) automatic call unit (38) to police connected alarm units (37) illumination equipment (32), closed-circuit monitor (34) and other components such as solenoid sensor (30) associated with an infra-red detector, to form a protective safety system against robbery, burglary and fire accident, to protect human life and property and to speedily identify the robber (burglar).

Figure 2:
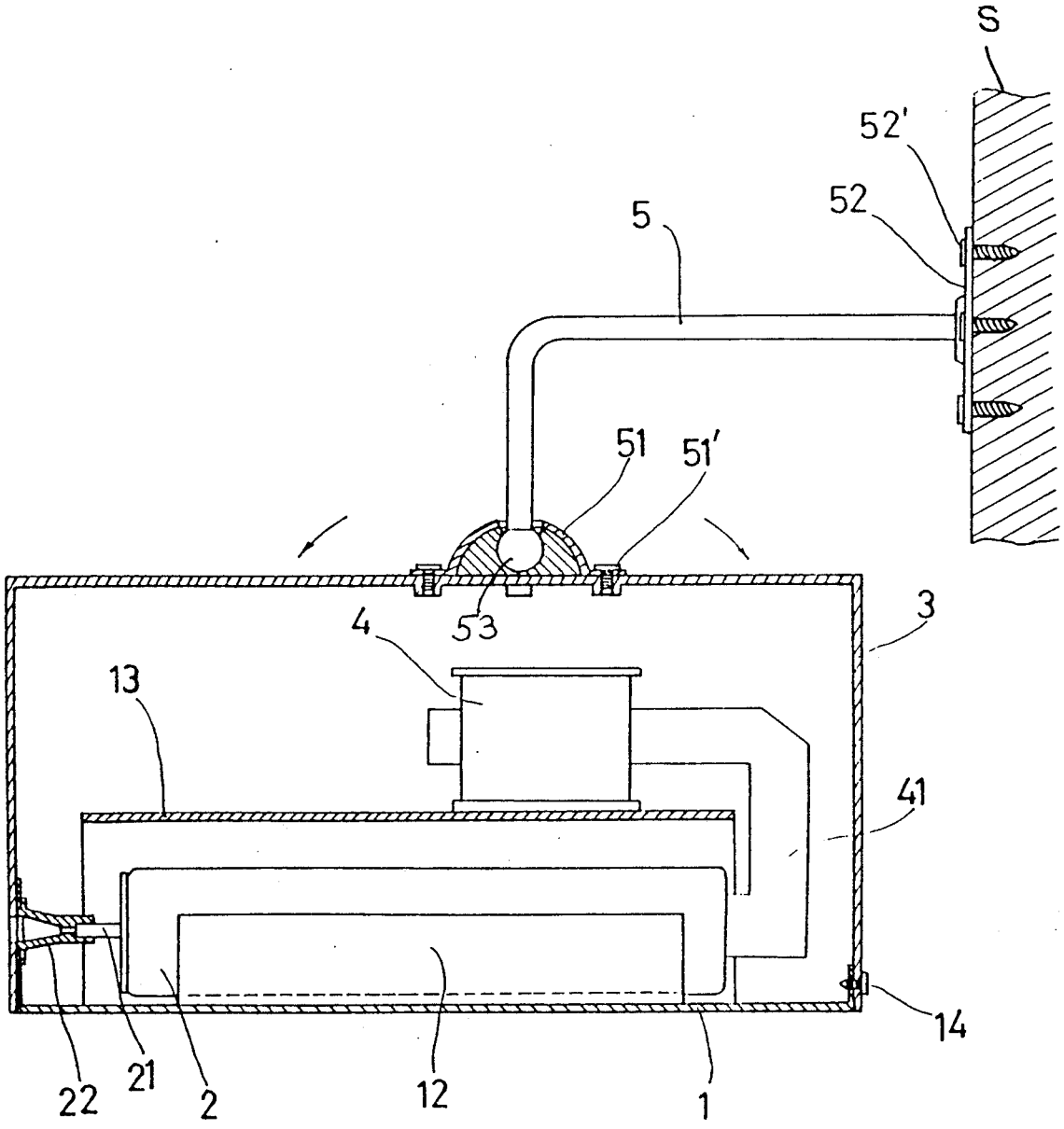
FIG. 2 is the section view of the invention.
Figure 3:
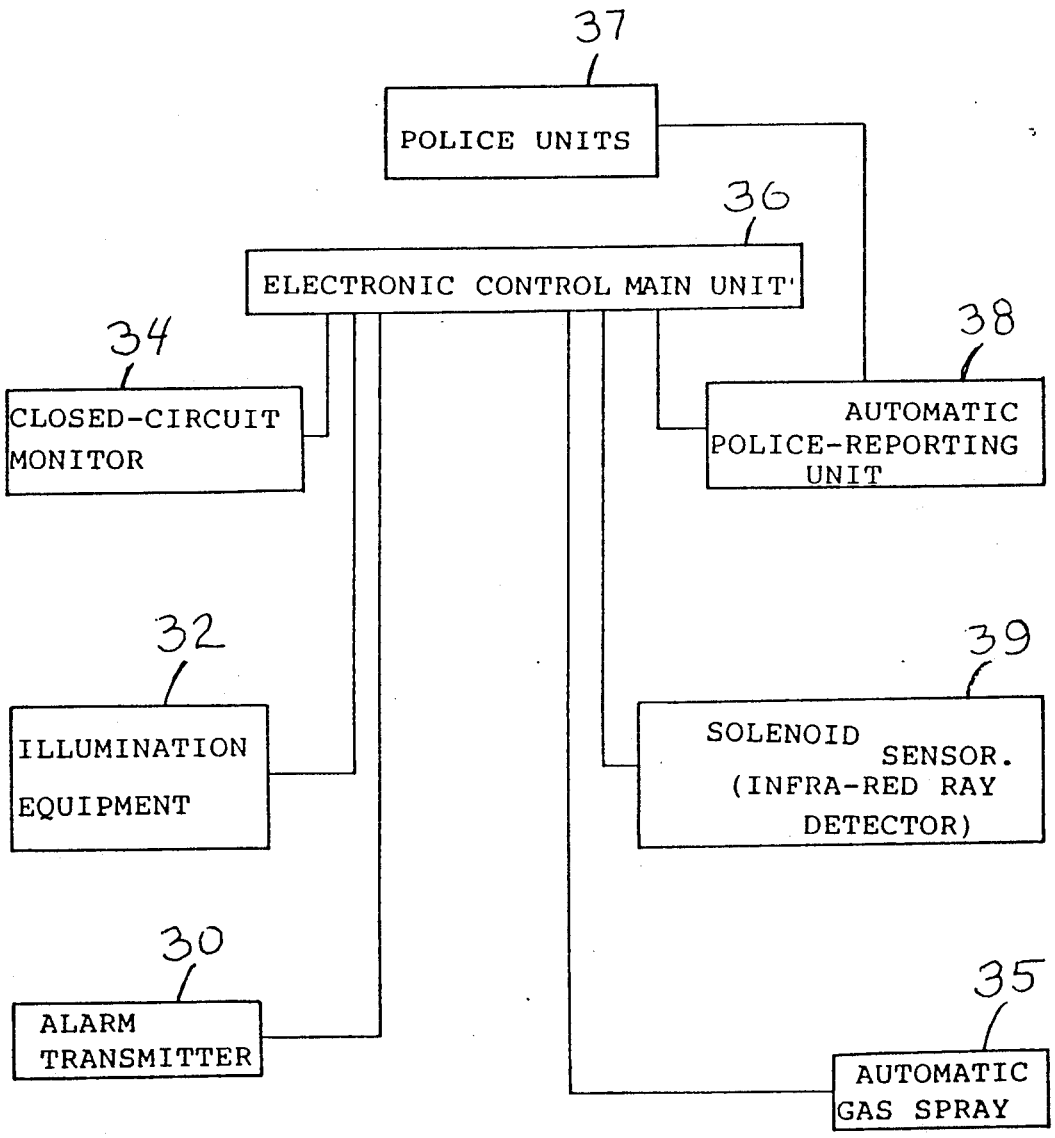
FIG. 3 is the flowchart of the invention's safety system.

Please refer to FIG. 1 and FIG. 2 which are the embodiment perspective and section views of the invention. In the base (1) is a sliding seat (12) in which is a gas cylinder (2), a push tube (21) at the front of the gas cylinder (2) is fitted with a spray nozzle (22), at an appropriate location of the base (1) is a shaped fixing seat (13) on which is mounted a solenoid (4) on a central push rod (41), one end of the central push rod (41) is in touch with an end of gas cylinder (2). When a sensor transmits signals via an electronic control main unit to activate the solenoid (4), then the central push rod (41) will push the gas cylinder (2), and gas will be sprayed from a nozzle (22), on top of the base (1) which is covered with a casing (3) fixed to the base by several screws (14). On top of the casing (3) there is a ball-shaped adjustor head seat (51) provided with a ball head (53) integrally formed with one end of a rack (5), the other end of the rack having a fixing plate (52) secured by screws (52') to a convenient wall surfaces.

What is claimed is:

1. A type of "automatic gas spray device and its safety system", comprising a base, sliding seat, fixing seat, solenoid, gas cylinder, spray nozzle, casing, rack, electronic control unit, alarm illumination equipment, closed-circuit monitor, and solenoid sensor, featuring a sliding seat at the top center of the base, a fixing seat secured on two sides of the base, on top of the fixing seat is said solenoid, a push tube at the front end of the gas cylinder is inserted in the spray nozzle, the base is covered by said casing which is provided on its top with an adjustor head seat adjustably coupling with a ball head formed at one end of a rack, the other end of said rack being coupled to a fixing plate which can be secured to a wall for supporting said device.

2. As described in claim 1, in which the electronic control unit, alarm, illumination equipment, closed-circuit monitor, and a solenoid sensor associated with an infra-red detector comprise a safety system against villains.

* * * * *